US007431077B2

(12) United States Patent
Streater, Jr. et al.

(10) Patent No.: US 7,431,077 B2
(45) Date of Patent: Oct. 7, 2008

(54) CABLE HANGER FOR USE IN A CABLE GUIDED FISHING ASSEMBLY

(75) Inventors: James R. Streater, Jr., Humble, TX (US); Gregg A. Bosley, Houston, TX (US); Donald L. Leach, Pearland, TX (US); David P. Ross, Katy, TX (US); C. Steven Isaacks, Cypress, TX (US)

(73) Assignee: National - Oilwell DHT, L.P., Houston, TX (US)

( * ) Notice: Subject to any disclaimer, the term of this patent is extended or adjusted under 35 U.S.C. 154(b) by 337 days.

(21) Appl. No.: 11/217,778

(22) Filed: Sep. 1, 2005

(65) Prior Publication Data

US 2007/0044970 A1 Mar. 1, 2007

(51) Int. Cl.
*F16G 11/02* (2006.01)

(52) U.S. Cl. ..... 166/85.1; 24/132 R

(58) Field of Classification Search ..... 166/85.1, 166/379; 24/132 R, 135 R
See application file for complete search history.

(56) References Cited

U.S. PATENT DOCUMENTS

| | | | | |
|---|---|---|---|---|
| 3,762,725 | A | 10/1973 | Taylor | 277/32 |
| 4,143,446 | A * | 3/1979 | Down | 24/115 R |
| 5,979,022 | A | 11/1999 | Cooper | 24/132 R |
| 6,550,536 | B2 | 4/2003 | Bernat | 166/301 |
| 7,097,141 | B2 * | 8/2006 | Heath | 248/62 |

OTHER PUBLICATIONS

International Search Report and Written Opinion, Jul. 16, 2007, for foreign counterpart PCT Application PCT/US06/32267.
Joe DeGeare, David Haughton, Mark McGurk, The Guide to Oilwell Fishing Operation.
Gulf Publishing Company, Oilwell Fishing Operations: Tools and Techniques, Aug. 1990.
Gunn Wireline; Wireline Tools.
National Oilwell, Cable Guided & Side Door Fishing Methods, 2004.

* cited by examiner

*Primary Examiner*—Jennifer H Gay
*Assistant Examiner*—Daniel P Stephenson
(74) *Attorney, Agent, or Firm*—Howrey LLP

(57) ABSTRACT

A cable hanger for use in a cable-guided fishing operation is disclosed. The disclosed invention provides a cable hanger in which a specially-shaped hanger body is connected to a handle having a cable groove running through it. The cable groove allows for the centerline of a cable to run through the centerline of the handle, thereby allowing for a straight-line pull to be exerted on the cable through the cable hanger. The specially-shaped hanger body is operatively connected to a specially-shaped body cover by a plurality of links. In this way, the hanger body and cover form a "clamshell" arrangement in which the cover can rotate from an open position to a closed position around the cable. When in the closed position, the cover and body are bolted together along the side of the cover and body opposite the links. The hanger body and cover are designed such that the cable rests closer to the links rather than in the center of the hanger body such that the moment arm between the bolts and the cable is increased, thereby increasing the amount of clamping force that can be provided by the bolts.

64 Claims, 5 Drawing Sheets

CABLE HANGER FOR USE IN A CABLE GUIDED FISHING ASSEMBLY

FIELD OF THE INVENTION

The present invention generally relates to equipment used for removing stuck downhole tools from an oil or gas well. In particular, the present invention relates to an improved cable hanger for use as part of a cable-guided fishing assembly used to remove downhole tools that have become stuck in a well.

BACKGROUND OF THE INVENTION

There are various methods of completion of and production from an oil or gas well. Typically, an oil or gas well is completed by cementing casing strings in place along substantially the entire depth of the well. Once the well is completed, production can commence. To facilitate the production of hydrocarbons or other fluids from the well, production tubing is typically installed within the cased wellbore. Production tubing is set in a portion of the well generally concentric with the casing. The production tubing allows communication of the producing zone of the well with the surface.

After the casing and production tubing are installed in the borehole, there is often need for various procedures to be performed on the well, such as perforating the well, well logging operations, and the like. These procedures are performed with tools that are typically attached to what is known as a wireline. The wireline is a metallic, braided cable with a plurality of electrical conductors contained therein, or is often just a metallic braided cable. The tools to be used for a given operation are lowered into the well on the end of the wireline and then activated or monitored at the surface by an operator. When operations with the tools are completed, the wireline and attached tool are pulled to the surface and removed from the well so that production can commence or resume, or so that further operations can be conducted in the well.

Occasionally, downhole tools become stuck in the well during the retrieval process. Downhole tools can become stuck in a well for various reasons, such as encountering a restriction that has formed in the inner diameter of the wellbore. Additionally, downhole tools sometimes become bridged over, or the line on which the tools are run becomes key-seated in the walls of the well bore, thereby hindering or preventing removal of the tools from the well. Often, these downhole tools are very expensive pieces of electronic instrumentation and/or have radioactive sources contained therein and, thus, they must be retrieved from the well. Moreover, these tools often present a hindrance to further operations in or production from the well and, thus, must be retrieved from the well. The procedure of retrieving a stuck tool is known as "fishing."

For situations in which the stuck tool is still attached to an intact wireline, either the cable-guided fishing method (also known as the "cut and strip" method) or the side-door overshot method is typically used to retrieve the tool. The cable-guided fishing method is typically used for deep, open-hole situations or when a radioactive instrument is stuck in the hole. For these situations, the cable-guided fishing method is a safe method that offers a high probability of success. In particular, the cable-guided fishing method allows retrieval of the stuck tool while the tool remains attached to the cable, thereby minimizing or removing the possibility that the tool will fall down the well during the fishing operation and allowing for the well bore to be cleared with a minimum of downtime. Further, in some instances, through use of the cable-guided fishing method, expensive multi-conductor cable can be salvaged.

The cable-guided fishing method is performed with a special set of tools (hereinafter referred to as the "fishing assembly"). The fishing assembly typically comprises a cable hanger with a T-bar, a spearhead rope socket, a rope socket, one or more sinker bars, a spearhead overshot, and a "C" plate. The fishing assembly may also comprise a swivel joint and a knuckle joint. To use the fishing assembly, the individual components of the assembly are assembled together in a series of steps. Specifically, a typical procedure for assembling the individual components of the fishing assembly is as follows (refer to FIG. 1 for a depiction of the individual components of the fishing assembly in their relative positions during and after assembly):

(1) a light pulling force is exerted on the wireline to remove any slack;

(2) a cable hanger (A) is attached to the wireline at the well head;

(3) the wireline is lowered until the cable hanger (A) rests on the well head or rotary table;

(4) the wireline is cut a short distance above the cable hanger (A);

(5) a spear head rope socket (B) is then "made up" to the end of the lower half of the severed wireline above the cable hanger (A);

(6) a rope socket (C) ("the upper rope socket") is made up to the end of the upper severed half of the wireline;

(7) one or more sinker bars (D) are connected to the upper rope socket (C);

(8) a spear head overshot (E) is connected to the lowermost sinker bar (D);

(9) the spear head overshot (E) is then engaged with the spear head rope socket (B), and a "test strain" is exerted on the assembly by "pulling" on the wireline to ensure that the components are properly connected;

(10) with the spear head overshot (E) engaged with the spear head rope socket (B), the wireline is then "pulled" to exert a force sufficient to raise the cable hanger (A) so that it can be removed from the assembly;

(11) after removing the cable hanger (A) from the assembly, a "C" plate (F) is placed under a specially-shaped section of the spear head rope socket (B);

(12) with the specially-shaped section of the spear head rope socket (B) resting on the "C" plate (F), the entire assembly can be lowered such that the "C" plate (F) rests on the well head or rotary table.

After assembling the individual components of the fishing assembly in this (or a similar) manner, the assembly can be used to "fish" the stuck tool out of the well.

In operation, the fishing assembly fishes the stuck tool out of the well in a series of steps. Specifically, the following steps are typical of the operation of the fishing assembly (refer to FIG. 2 for a depiction of the individual components of the fishing assembly in their relative positions during operation):

(1) the spear head overshot (E) is disconnected from the spear head rope socket (B) and raised up to the derrick man;

(2) the derrick man will then thread the spear head overshot (E) and sinker bar (D) through the first stand of pipe (G) to be run into the well as part of the fishing operation;

(3) the driller will then pick up the first stand of pipe (G) and suspend it over the well head;

(4) the spear head overshot (E) should then be connected to the spear head rope socket (B), a light strain taken on the cable, and the "C" Plate (F in FIG. 1) removed;

(5) the first stand of pipe (G) is then run in the well bore and slips (H) are set;

(6) the "C" Plate is then replaced, and the assembly is allowed to rest on the tool joint;

(7) the spear head overshot (E) is then disconnected and raised back up to the derrick man;

(8) the derrick man threads the spear head overshot (E) and sinker bar (D) through the next stand of pipe (I), which in turn is picked up by the driller and suspended over the well head through use of the rig's elevator (J);

(9) the spear head overshot (E) is connected to the spear head rope socket (B), the "C" Plate is removed, and the second stand of pipe (I) is stabbed into and made up to the first stand of pipe (G) and run into the well bore;

(10) the "C" Plate is replaced, the spear head overshot (E) is again disconnected and raised up to the derrick man, and the procedure is repeated until enough pipe has been run into the well to contact and free the stuck tool;

(11) after the fish has been contacted and pulled free, the cable hanger (A in FIG. 1) is again placed on the cable, the rope sockets (B, C) are removed from the cable, and the cable tied together;

(12) the elevator (J) is then latched around the "T" bar on the cable hanger, and a strain sufficient to pull the cable out of the tool is taken;

(13) the cable hanger is then removed, and the free cable is spooled on to a service truck reel;

(14) the fishing string along with the fish may then be pulled from the hole in the conventional manner.

While the fishing assembly and method of use described in the preceding paragraphs has proven to be quite successful, shortcomings with some of the components of the fishing assembly have been identified. For example, prior art cable hangers (such as is shown in FIG. 3) are designed with a "T-bar" handle that is offset from the centerline of the cable. Because the centerline of the handle is offset from the centerline of the cable, the pulling force on the handle does not create a straight-line pull force on the cable, but rather the pull force acting on the cable is slightly angled. This angled pulling force exerted on the cable can cause the cable to "kink." If a substantial pulling force is exerted on the cable, such a kink can damage the wireline.

Additionally, prior art cable hangers (FIG. 3) typically utilize a fabricated tool body in which the length of the "throat" of the cable hanger (i.e., the length from the handle to the "clamping body" of the cable hanger) cannot be changed without replacing substantially the entire cable hanger body. Because the throat length of a cable hanger may need to be changed from time to time, having to replace the entire cable hanger body, which requires having multiple sizes of cable hanger bodies on hand, can be both expensive and time consuming.

Further, prior art cable hangers typically include a "liner" (of a type shown in FIG. 4) on which the cable rests within the cable hanger body. These liners are typically made of brass and, as can be seen in FIG. 4, utilize multiple screws to hold the liner in place within the cable hanger. Although these screws are not load bearing, the screws of the prior art liners would occasionally get "pinched" when high loads were exerted on the liner, thereby making it difficult to remove the screws and the liner from the cable hanger for replacement.

Finally, the prior art cable hangers typically included eight bolts—four bolts on each side of the center-line of the cable hanger body—to "clamp" the upper plate and lower plate of the hanger body around the cable. In such prior art cable hangers, it was important to ensure that the cable was centered between the sets of bolts on either side of the center-line so that the distance between the cable and each set of bolts was the same (or substantially the same). If the cable was not centered in the hanger body, the moment arm of one set of bolts (i.e., the distance between the bolts and the cable) would be shorter than the moment arm of the other set of bolts. In such a situation, if an equal torque is exerted on both sets of bolts, one set of bolts has "leverage" over the other set of bolts such that the force exerted on one set of bolts could exceed the yield strength of the bolts. As such, a lower torque may be applied to the bolts to guard against such a problem arising, which ultimately leads to a reduced clamping force that could be placed on the cable. Additionally, the need to tighten and adjust the torque on eight individual bolts is tedious and time consuming.

Accordingly, what is needed is a cable hanger that is designed to ensure a straight pull on the cable. Additionally, an improved liner is needed that is less susceptible to being damaged or to becoming "stuck" in the cable hanger when a pulling force is exerted on the cable hanger. Further, a cable hanger that can be "clamped" about the cable in less time and with greater force is needed. Finally, a cable hanger that allows for changes in the "throat" length of the hanger without replacing substantially the entire cable hanger body is needed. It is, therefore, an object of the present invention to provide a cable hanger that meets these needs and eliminates the problems with prior art cable hangers identified above. The ability of the improved cable hanger disclosed and claimed herein to meet these objectives will become apparent to those of skill in the art from a review of the specification below.

SUMMARY OF THE INVENTION

An improved cable hanger used in a cable-guided fishing assembly is disclosed. The disclosed invention is a unique cable hanger in which a specially-shaped hanger body is connected to a handle having a cable groove running through it. The cable groove allows for the centerline of the cable to run through the centerline of the handle, thereby allowing for a straight-line pull to be exerted on the cable through the cable hanger.

The specially-shaped hanger body is operatively connected to a specially-shaped body cover by a plurality of links. In this way, the hanger body and cover form a "clamshell" arrangement in which the cover can rotate from an open position to a closed position around a cable. When in the closed position, the cover and body are bolted together along the side of the cover and body opposite the links.

The use of links to connect one side of the cover to the hanger body eliminates one set of bolts that would normally be required to clamp the cover and hanger body together around a cable. By eliminating a set of bolts, the cable hanger of the present invention can be more quickly clamped around a cable, as only one set of bolts must be torqued and adjusted during the clamping operation.

Further, in the preferred embodiment of the present invention, the hanger body and cover are designed such that the cable rests closer to the links rather than in the center of the hanger body when the hanger body and cover are clamped around the cable. In this way, the moment arm between the bolts and the cable is increased, and the amount of clamping force that the bolts can provide is thereby increased. Thus, the unique "clamshell" design of the disclosed invention allows for a higher clamping force to be exerted on the cable.

The hanger body is connected to the handle by one or more connector rods that are inserted through the handle and threaded into the hanger body. The use of one or more separate connector rods to connect the handle to the hanger body allows for easy modification of the throat length of the cable hanger by simply replacing the existing connector rods with either longer or shorter connecting rods.

The cable hanger of the present invention also utilizes a specially designed liner having a plurality of "notches" along the outside edges of the liner such that the liner is held in place within the hanger body and cover by the heads of large head diameter machine screws, such as for example pan-head screws, resting in the notches. In this way, the screws do not pass through the liner, and the liner is less likely to "pinch" or shear the screws in the event the liner moves in response to a pulling force exerted on the cable hanger.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

FIG. 12 shows the cable hanger in the open position ready to receive a cable in accordance with the preferred embodiment of the present invention.

DESCRIPTION OF ILLUSTRATIVE EMBODIMENTS

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Figure 1:
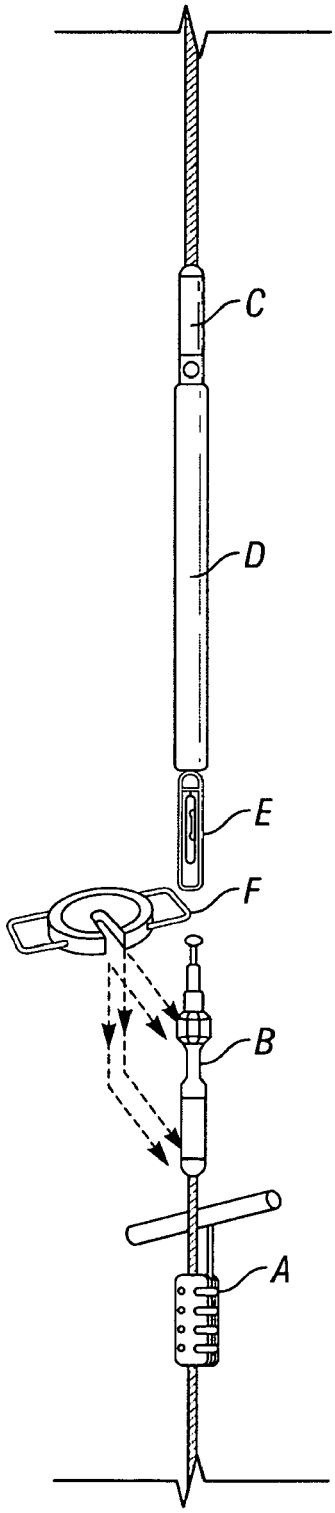
FIG. 1 is a side view of a typical cable-guided fishing assembly showing the various components of such assembly in their respective positions.
Figure 2:
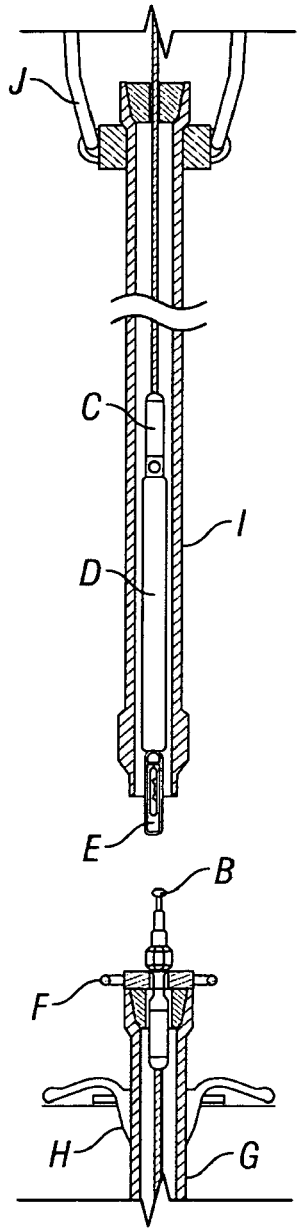
FIG. 2 is a side view of a typical cable-guided fishing assembly showing the various components of such assembly in their respective positions within tubular members during operation.
Figure 3:
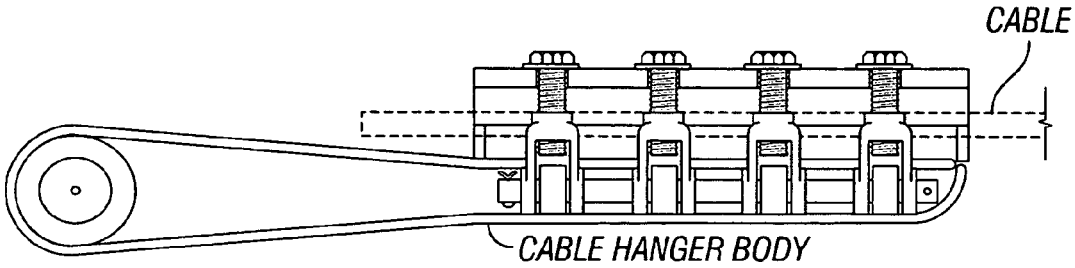
FIG. 3 (Prior Art)
FIG. 3 is a side view of a prior art cable hanger.
Figure 4:
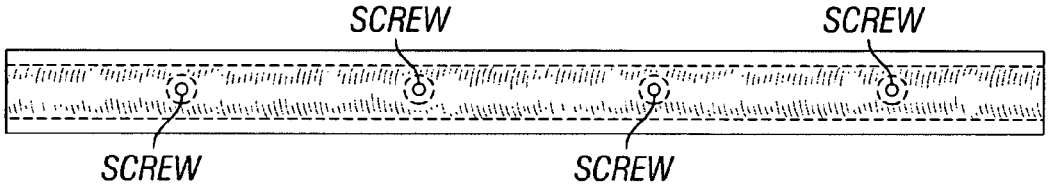
FIG. 4 (Prior Art)
FIG. 4 is a top view of a prior art cable hanger liner showing the locations of the screws that hold the liner in place within the cable hanger.
Figure 5:
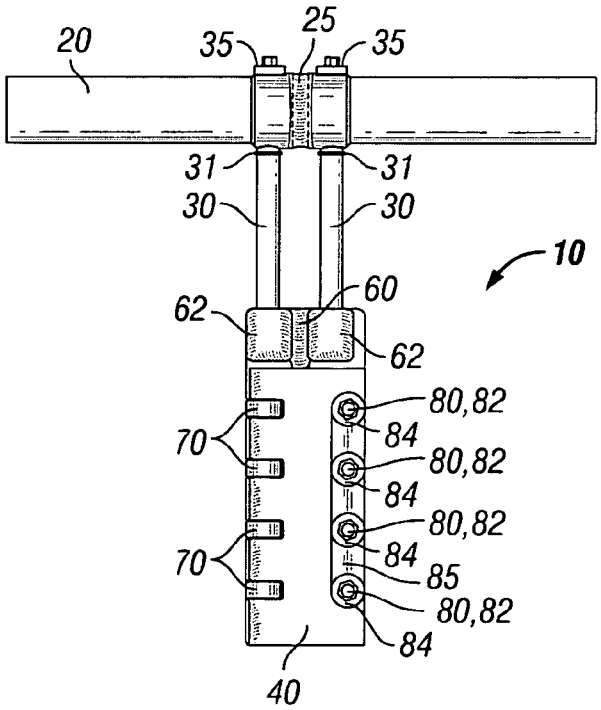
FIG. 5 is a front view of a cable hanger in accordance with the preferred embodiment of the present invention.
Figure 6:
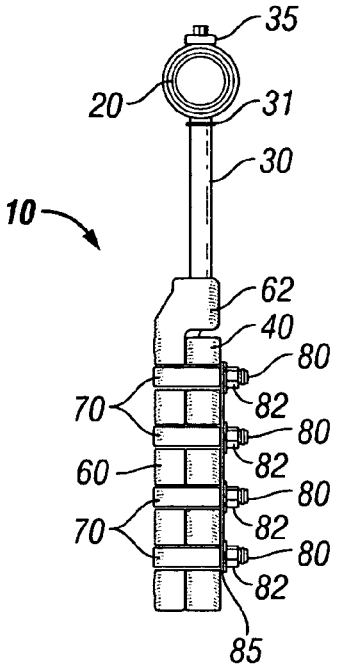
FIG. 6 is a side view of the cable hanger shown in FIG. 5.
Figure 7:
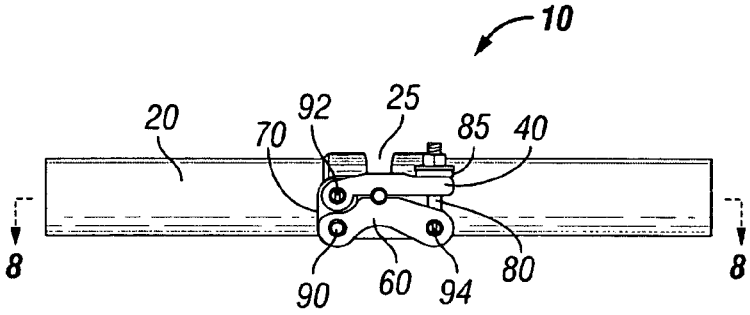
FIG. 7 is a bottom view of the cable hanger shown in FIG. 5.

Referring to FIGS. 5 through 7, the cable hanger 10 of the present invention is shown in various views. In FIGS. 5 through 7, cable hanger 10 is shown in the closed position as if "clamped" around a cable.

The components of cable hanger 10 include hanger body 60, body cover 40, connector rods 30 and handle 20. As shown in FIGS. 5 and 6, connector rods 30 pass through handle 20 and are threadedly connected to hanger body 60 within housings 62 (see FIG. 8) and may be further secured in the housings with spring pins (not shown in FIG. 8). Connector rods 30 are held in place within handle 20 by retainer rings 31 and plates 35. In this manner, the connector rods 30 operatively connect handle 20 to hanger body 60. The use of separate connector rods 30 to connect the handle 20 to the hanger body 60 allows for easy modification of the throat length of the cable hanger 10 by simply replacing the existing connector rods 30 with either longer or shorter connecting rods 30.

While the preferred embodiment of cable hanger 10 shown in FIGS. 5 through 7 uses two connector rods 30, one of skill in the art will appreciate that alternative embodiments of the disclosed invention may use only one or may use more than two connector rods 30 to connect handle 20 to hanger body 60 depending on numerous factors, including the size of the cable hanger 10 and the rating of the cable hanger (i.e., the upper limit of the pull force that can be safely exerted on the cable hanger 10). Similarly, although the preferred embodiment shows connector rods 30 connected to hanger body 60, one of skill in the art will appreciate that alternative embodiments exist in which connector rods 30 may be connected to body cover 40. Further, plates 35 are circular plates integrally formed as part of the connector rod 30 in the preferred embodiment shown in FIGS. 5 through 7. One of skill in the art will appreciate, however, that plates 35 can be attached to connector rods 30 in other ways such as by welding or by using a threaded upper end for connector rods 30 and threading a separate threaded fastener onto the upper end of the connector rods 30.

FIGS. 5 and 7 show cable groove 25 formed in handle 20 in accordance with the preferred embodiment of the present invention. Cable groove 25 is designed to allow the centerline of the cable to run through the centerline of the handle 20, thereby allowing for a straight-line pull to be exerted on a cable through the cable hanger 10.

FIGS. 5 through 7 also show the unique shape of hanger body 60 and body cover 40 of the cable hanger 10. The unique shape of these components is discussed in more detail with reference to FIG. 12.

Hanger body 60 and body cover 40 are designed to be operatively connected together by a plurality of links 70. As shown in FIGS. 5 through 7, the plurality of links 70 connect the left side of hanger body 60 to the left side of body cover 40. The links 70 reside in notches formed in the hanger body 60 and the body cover 40 and are designed such that rods 90 and 92 pass through openings 72 and 74 of link 70 (shown in FIG. 10). Rods 90 and 92 extend through substantially the entire length of hanger body 60 and body cover 40 respectively, thereby passing through each link 70. In operation, when body cover 40 is opened or closed, the links 70 rotate about rods 90 and 92. In this way, the hanger body 60 and body cover 40 form a "clamshell" arrangement in which the body cover 40 can rotate from an open position to a closed position around a cable.

The use of links 70 to connect one side of the hanger body 60 and the body cover 40 eliminates one set of mechanical fasteners, such as nuts and bolts, that would normally be required to clamp the body cover 40 and hanger body 60 together around a cable. By eliminating a set of nuts and bolts, the cable hanger 10 of the present invention can be more quickly clamped around a cable, as only one set of nuts and bolts must be torqued and adjusted during the clamping operation.

When in the closed position, the hanger body 60 and the body cover 40 are mechanically fastened together along the side of the hanger body 60 and body cover 40 opposite the links 70 by a plurality of specially-shaped bolts 80 and nuts 82. As shown in FIGS. 5 through 7, the bolts 80 pass through washer plate 85 and washers 84 before nuts 82 are connected to the threaded ends of bolts 80 to secure the cable hanger 10 in the closed position. The benefits of using the unique washer plate 85 are discussed with reference to FIG. 12.

While the preferred embodiment of the present invention utilizes nuts 82 and connecting bolt 80 to secure the body cover 40 to the hanger body 60 in the closed position as shown in the figures, one of skill in the art will appreciate that other means can be employed to secure the cable hanger 10 in the closed position. By way of example, the orientation of the connecting bolts 80 and nuts 82 can be turned upside down such that the nuts 82 are secured to the connecting bolts 80 on the underside of the hanger body 60. Similarly, instead of using nuts 82, hanger body 60 or body cover 40 could include threaded holes threaded to receive the threaded ends of connector bolts 80, thereby eliminating the need for separate nuts 82.

Figure 8:
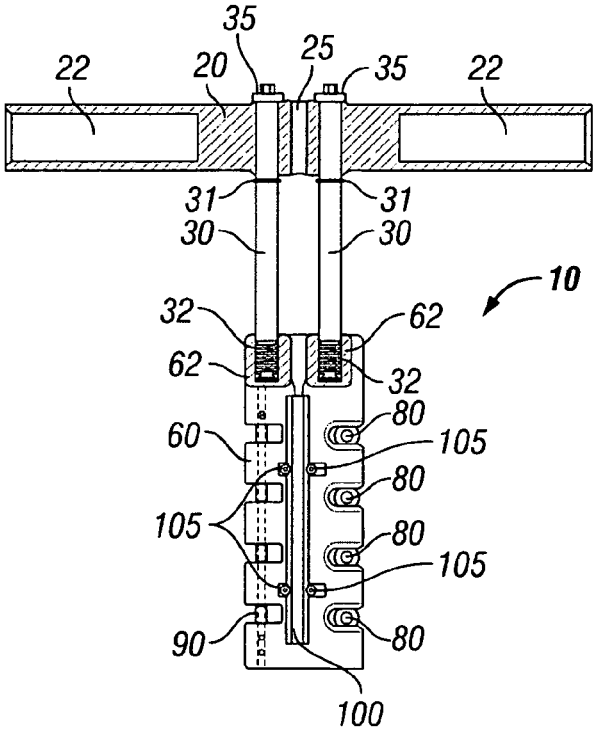
FIG. 8 is a vertical cross-sectional view of the cable hanger of FIG. 5 viewed along the line 8-8 of FIG. 7. In the cross-sectional view of FIG. 8, the links and body cover have been removed from the cable hanger shown in FIG. 5 so that additional components of the cable hanger can be viewed.

Referring to FIG. 8, a vertical cross-sectional view of cable hanger 10 is shown. FIG. 8 shows connector rods 30 passing through handle 20 and held in place in the handle by retaining rings 31 and plates 35. FIG. 8 also shows the threaded ends 32 of connector rods 30 threadedly engaged with the hanger body 60 within housings 62.

Rod 90 can also be seen in FIG. 8 passing through the left side of hanger body 60. As noted, rod 90 is designed to pass through a plurality of links 70 (not shown in FIG. 8) as part of the "clamshell" design of cable hanger 10 (refer to FIG. 7). Although not shown in the cross-sectional view of FIG. 8, similar rod 92 passes through the right side of body cover 40 and through the plurality of links 70 (refer to FIG. 7). Rods 90 and 92 (as well as rod 94 that passes through bolts 80 and through the right side of hanger body 60) are held in their operational position with spring pins.

Figure 12:
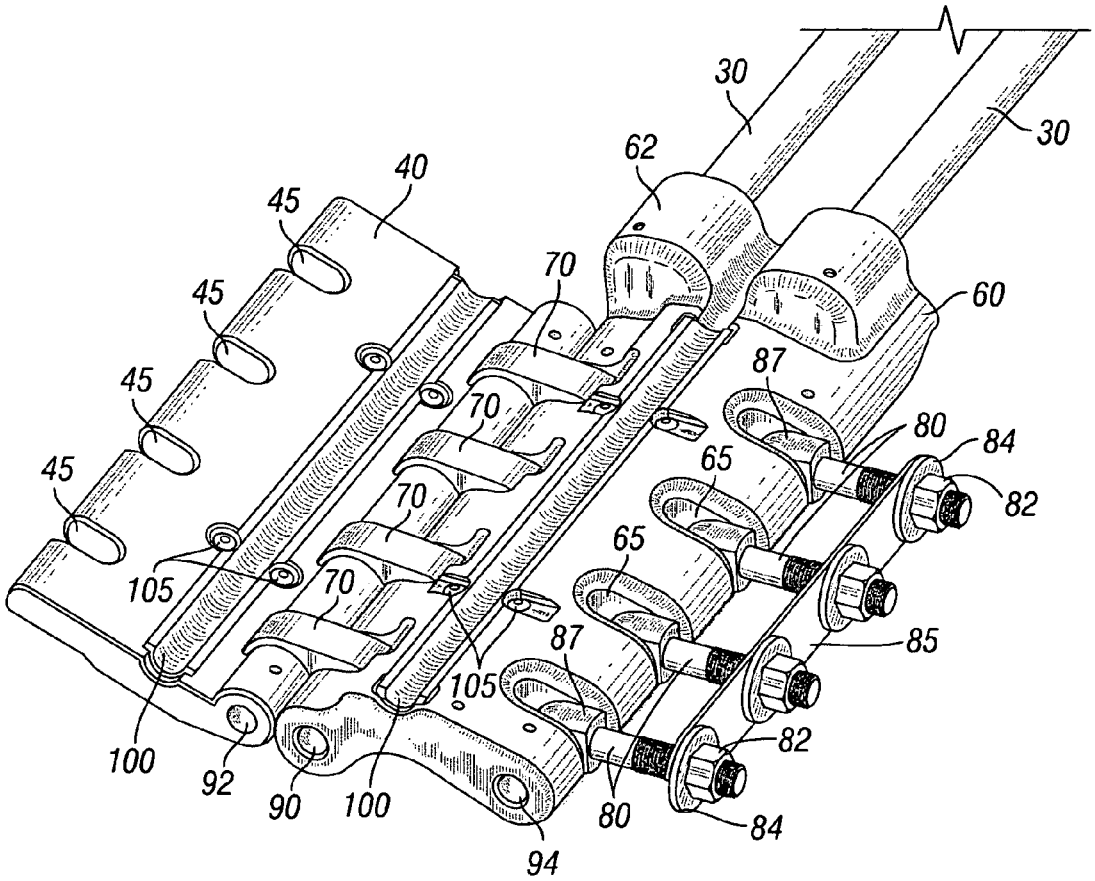
FIG. 12 is a three-dimensional view of the cable hanger shown in FIG. 5.

Further, FIG. 8 shows liner 100 in its operative position within hanger body 60. An identical (or substantially identical) liner 100 is placed in body cover 40 (as shown in FIG. 12). Liner 100 is specially designed to eliminate the need for holding screws to be screwed through the liner 100 into hanger body 60 and/or body cover 40. The unique design and method of holding liner 100 in place in the cable hanger 10 is discussed in more detail with reference to FIGS. 9 and 12.

As shown in FIG. 8, the hanger body 60 (and as shown in FIG. 12 the body cover 40) are designed such that liner 100, and thus a cable when cable hanger 10 is closed around a cable, rests closer to links 70 rather than in the center of cable hanger 10 when the hanger body 60 and the body cover 40 are clamped around the cable. By offsetting where the cable rests within the cable hanger 10, the moment arm between the bolts 80 and the cable is increased, and the amount of clamping force that the bolts 80 can provide is thereby increased. Thus, the unique "clamshell" design of the disclosed invention allows for a higher clamping force to be exerted on the cable. The higher clamping force allows for the cable hanger 10 of the present invention to be rated for a higher pull force.

FIG. 8 also shows hollow chambers 22 formed in handle 20 in the preferred embodiment. Chambers 22 are formed in handle 20 to reduce the weight of handle 20 and, thus, reduce the overall weight of the entire cable hanger 10.

Figure 9:
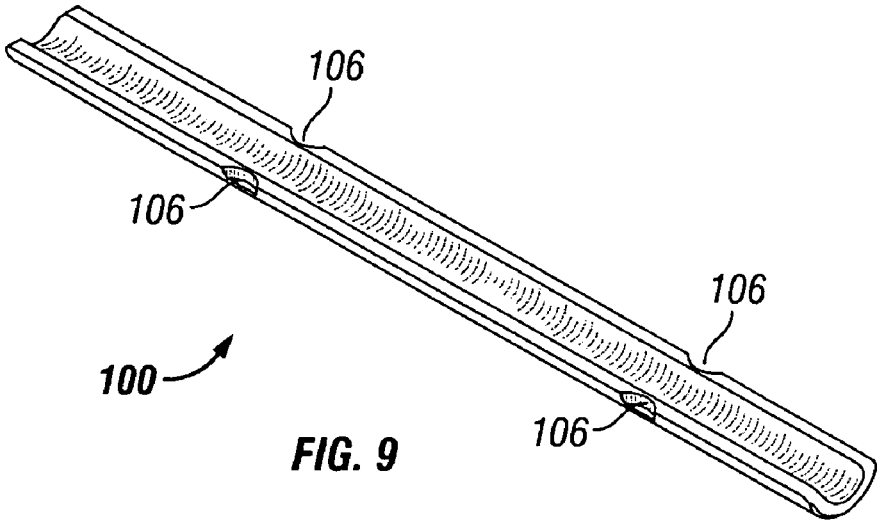
FIG. 9 is a three-dimensional drawing of a liner used in accordance with the preferred embodiment of the present invention. The liner shown in FIG. 9 is shown in its operational placement in FIGS. 8 and 12.

Referring to FIG. 9, the liner 100 of the present invention is shown in more detail. The specially designed liner 100 of the preferred embodiment has a plurality of notches 106 along the outside edges of the liner 100 such that the liner 100 is held in place within the hanger body 60 and body cover 40 by the heads of screws 105 (shown in FIGS. 8 and 12) resting in the notches 106. In the preferred embodiment, screws 105 are large head diameter machine screws, such as pan-head screws. In this way, the screws 105 holding liner 100 in place do not pass through liner 100, and the liner 100 is less likely to hinder removal of the screws 105 (or, in the worst case, to shear the screws 105) in the event the liner 100 moves in response to a pulling force exerted on the cable hanger 10.

In the preferred embodiment, liner 100 is made of brass and is thicker than typical prior art liners. One of skill in the art will appreciate, however, that liner 100 can be made of any suitable metal, and can be made of any suitable thickness, that can withstand the forces acting on the liner 100 during use of the cable hanger 10. Similarly, although four notches 106 are shown in the preferred embodiment of the present invention, one of skill in the art will appreciate that the number of notches 106 formed along the edges of liner 100 can vary depending on the length of liner 100.

Figure 10:
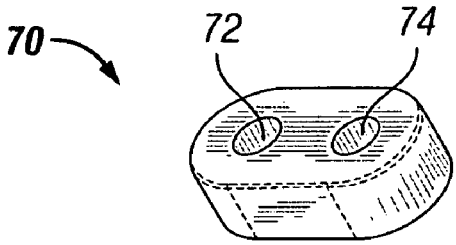
FIG. 10 is a three-dimensional drawing of a link used in accordance with the preferred embodiment of the present invention. The link shown in FIG. 10 is shown in its operational placement in FIGS. 5-7 and 12.

Referring to FIG. 10, one of the plurality of links 70 is shown in more detail. As noted above, the link 70 is designed with openings 72 and 74 that are designed to allow rods 90 and 92 to pass through link 70 to allow link 70 to operatively connect the left side of hanger body 60 and the right side of body cover 40 to form the "clamshell" design of the cable hanger 10. While the preferred embodiment utilizes four links 70, one of skill in the art will appreciate that fewer than four or more than four links can be used depending on multiple factors, including the sizes of hanger body 60 and body cover 40 and the size and strength of links 70.

Figure 11:
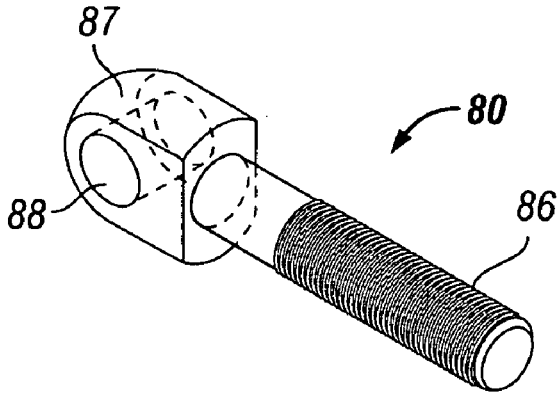
FIG. 11 is a three-dimensional drawing of a specially designed connecting bolt used in accordance with the preferred embodiment of the present invention. The bolt shown in FIG. 11 is shown in its operational placement in FIGS. 7, 8, and 12.

Referring to FIG. 11, the connecting bolt 80 of the preferred embodiment is shown in more detail. Connecting bolt 80 is comprised of post 86 and end section 87. As can be seen in FIG. 11, end section 87 is specially designed with opening 88 running through it. Opening 88 is shaped and sized to allow rod 94 to pass through it to hold a plurality of connecting bolts 80 in place within a plurality of notches 65 formed along the right side of hanger body 60 (shown in FIG. 12). In this way, connecting bolts 80 are allowed to rotate about rod 94 to a substantially vertical position wherein the posts 86 of connecting bolts 80 reside within the notches 45 in the body cover 40 when the cable hanger 10 is in the closed position around a cable. While the preferred embodiment utilizes four bolts 80, one of skill in the art will appreciate that fewer than four or more than four bolts can be used depending on multiple factors, including the sizes of hanger body 60 and body cover 40 and the size and strength of bolts 80.

Referring to FIG. 12, a cable hanger 10 in accordance with the preferred embodiment of the present invention is shown in the open position ready to receive a cable. The unique shapes of hanger body 60 and body cover 40 are shown in more detail in FIG. 12. Hanger body 60 and body cover 40 are specially designed such that they can be cast as individual pieces rather than fabricated. The development of the unique shapes of these components was aided through finite element analysis to ensure that these components would be lightweight and capable of being cast as one piece while still maintaining sufficient strength required to handle the pulling forces exerted on the cable hanger 10 during use. One of the benefits of casting hanger body 60 and body cover 40 is the enhanced ability to inspect these pieces for manufacturing problems through such techniques as magnetic particle inspection—a technique that is not well suited for use on a fabricated cable hanger such as in the prior art.

In operation, cable hanger 10 is placed around a cable such that the cable rests within the liner 100 in hanger body 60. Although not shown in FIG. 12, the cable will pass between connector rods 30 and through the centerline of handle 20 via the cable groove 25 (shown in FIGS. 5, 7, and 8).

With the cable properly seated in liner 100 of the hanger body 60, body cover 40 will be rotated about rods 90 and 92 passing through the plurality of links 70 until liner 100 of the body cover 40 rests on top of the cable. In this position, the body cover 40 is in the closed position and is ready to be secured in this position so that a clamping force will be applied to the cable.

With body cover 40 in the closed position, the plurality of connecting bolts 80 are rotated about rod 94 to a vertical (or substantially vertical) clamping position in which the posts 86 of the connecting bolts 80 reside within the notches 45 of the body cover 40. Rotation of connecting bolts 80 to the clamping position is aided by the washer plate 85 through which the posts 86 of each connecting bolt 80 pass. Washer plate 85 allows each of the connecting bolts 80 to be moved in a single action rather than one-by-one. Further, washer plate 85 ensures that each of the plurality of connecting bolts 80 will reside at the same depth within notches 45 in the body cover 40.

When the connecting bolts 80 have been rotated to the clamping position, nuts 82 are then tightened onto the threaded portions of posts 86 of the connecting bolts 80 until the appropriate amount of torque has been applied. With the nuts 82 appropriately torqued, the body cover 40 is tightly secured in engagement with hanger body 60, and the cable hanger 10 is "clamped" in place about the cable. The cable hanger 10 is now ready for use as part of a cable guided fishing operation.

While the cable hanger 10 of the present invention is designed for use as part of a cable-guided fishing assembly, one of skill in the art will appreciate that the cable hanger 10 can be used on its own, i.e., without the remaining components of a typical cable-guided fishing assembly. If it is desired to use the cable hanger 10 on its own, a pull force can be exerted on the cable hanger 10 to attempt to remove the stuck tool. In such use, the pulling force places only the cable below the cable hanger 10 in tension, while the cable above the cable hanger 10 is not in tension. In this way, if the cable breaks during the fishing operation, the cable above the cable hanger 10 will not "snap" or "recoil" like a rubber band breaking, and a potential safety hazard is eliminated.

Additionally, while the cable hanger 10 of the present invention can be used as part of a fishing operation in cased hole applications, one of skill in the art will appreciate that the cable hanger 10 of the present invention can also be used in open hole fishing operations.

While the apparatus, compositions and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

The invention claimed is:

1. A cable hanger comprising:

a hanger body having a cable groove for receiving a cable;

a hanger body cover having a cable groove for receiving the cable, the grooves of the hanger body cover and hanger body being configured such that each groove is offset from a centerline of the hanger body, thereby securing the cable in an off-center position when the hanger body and hanger body cover are in a closed position;

a handle connected to the hanger body by one or more connector rods, the handle having a groove therein for receiving the cable;

a plurality of links for operatively connecting the hanger body cover to the hanger body;

a plurality of connecting bolts and a plurality of fasteners, the plurality of connecting bolts and the plurality of fasteners designed to clamp the hanger body cover and the hanger body in the closed position about the cable.

2. The cable hanger of claim 1 further comprising a liner resting within the cable groove of the hanger body.

3. The cable hanger of claim 2 wherein the liner has one or more notches along each side of the liner.

4. The cable hanger of claim 3 wherein the liner is held in the cable groove of the hanger body by a plurality of screws.

5. The cable hanger of claim 4 wherein the plurality of screws do not pass through the liner, but rather the one or more notches along each side of the liner receive a portion of heads of the plurality of screws to hold the liner in the cable groove of the hanger body.

6. The cable hanger of claim 5 further comprising a liner resting within the cable groove of the hanger body cover.

7. The cable hanger of claim 6 wherein the liner has one or more notches along each side of the liner.

8. The cable hanger of claim 7 wherein the liner is held in the cable groove of the hanger body cover by a plurality of screws.

9. The cable hanger of claim 8 wherein the plurality of screws do not pass through the liner, but rather the one or more notches along each side of the liner receive a portion of heads of the plurality of screws to hold the liner in the cable groove of the hanger body cover.

10. The cable hanger of claim 9 further comprising a first set of notches in the hanger body and a first set of notches in the hanger body cover, said notches designed to receive the plurality of links.

11. The cable hanger of claim 10 wherein the plurality of links each have a plurality of openings passing through the links.

12. The cable hanger of claim 11 further comprising a rod passing through one of the plurality of openings of each of the plurality of links and passing through the hanger body, thereby securing the plurality of links in the first set of notches in the hanger body.

13. The cable hanger of claim 12 further comprising a rod passing through one of the plurality of openings of each of the plurality of links and passing through the hanger body cover, thereby securing the plurality of links in the first set of notches in the hanger body cover.

14. The cable hanger of claim 13 further comprising a plurality of spring pins adapted for securing the rods in place within the hanger body and within the hanger body cover.

15. The cable hanger of claim 14 further comprising a second set of notches in the hanger body and a second set of notches in the hanger body cover, said notches designed to receive the plurality of connecting bolts.

16. The cable hanger of claim 15 wherein the plurality of connecting bolts each have an opening passing through an end of the connecting bolts.

17. The cable hanger of claim 16 further comprising a rod passing through the opening in the end of each of the plurality of connecting bolts and passing through the hanger body, thereby securing the plurality of connecting bolts in the second set of notches in the hanger body.

18. The cable hanger of claim 17 wherein the cable groove in the hanger body is offset from the centerline of the hanger body in a direction toward the first set of notches in the hanger body.

19. The cable hanger of claim 18 wherein the cable groove in the hanger body cover is offset from the centerline of the hanger body cover in a direction toward the first set of notches in the hanger body cover.

20. The cable hanger of claim 16 further comprising a rod passing through the opening in the end of each of the plurality of connecting bolts and passing through the hanger body cover, thereby securing the plurality of connecting bolts in the second set of notches in the hanger body cover.

21. The cable hanger of claim 1 further comprising a washer plate with a plurality of openings for allowing an end of each of the plurality of connecting bolts to pass through the washer plate.

22. The cable hanger of claim 1 wherein the one or more connector rods are threadably connected to the hanger body.

23. The cable hanger of claim 1 wherein each of the one or more connector rods passes through the handle.

24. The cable hanger of claim 23 wherein each of the one or more connector rods is secured within the handle by a retainer ring.

25. The cable hanger of claim 23 wherein each of the one or more connector rods is secured within the handle by a circular plate integrally formed on each of the one or more connector rods.

26. The cable hanger of claim 23 wherein each of the one or more connector rods is secured within the handle by a circular plate attached around each of the one or more connector rods.

27. The cable hanger of claim 1 wherein the groove in the handle is formed such that a centerline of the cable passes though the centerline of the handle when the cable is placed within the cable hanger.

28. The cable hanger of claim 1 wherein the handle further comprises one or more hollow chambers in the handle for reducing the weight of the handle.

29. The cable hanger of claim 1 wherein the plurality of connecting bolts comprise a threaded portion and the plurality of fasteners comprise nuts designed to threadably engage the threaded portion of the plurality of connecting bolts.

30. A cable hanger comprising:

a hanger body comprising a cable groove for receiving a cable, the cable groove formed such that it is offset from the centerline of the hanger body;

a hanger body cover comprising a cable groove for receiving the cable, the cable groove formed such that it is offset from the centerline of the hanger body cover such that it lines up with the cable groove of the hanger body when the hanger body cover and the hanger body are in a closed position;

a liner positioned in the cable groove of the hanger body, the liner secured in the cable groove of the hanger body by a plurality of screws;

a liner positioned in the cable groove of the hanger body cover, the liner secured in the cable groove of the hanger body cover by a plurality of screws;

a handle connected to the hanger body by a plurality of connector rods, the handle having a groove therein for receiving a cable;

a plurality of links for operatively connecting the hanger body cover to the hanger body;

a plurality of connecting bolts and a plurality of fasteners, the plurality of connecting bolts and the plurality of fasteners designed to clamp the hanger body cover and the hanger body in a closed position about a cable.

31. The cable hanger of claim 30 further comprising a rod passing through the hanger body and a rod passing through the hanger body cover such that the rods hold the plurality of links in position, the rods held in place by one or more spring pins.

32. The cable hanger of claim 30 wherein the plurality of screws securing the liner in the cable groove of the hanger body do not pass through the liner.

33. The cable hanger of claim 30 wherein the plurality of screws securing the liner in the cable groove of the hanger body cover do not pass through the liner.

34. The cable hanger of claim 30 further comprising a first set of notches in the hanger body and a first set of notches in the hanger body cover, said notches designed to receive the plurality of links.

35. The cable hanger of claim 34 wherein the plurality of links each have a plurality of openings passing through the links.

36. The cable hanger of claim 35 further comprising a rod passing through one of the plurality of openings of each of the plurality of links and passing through the hanger body, thereby securing the plurality of links in the first set of notches in the hanger body.

37. The cable hanger of claim 36 further comprising a rod passing through one of the plurality of openings of each of the plurality of links and passing through the hanger body cover, thereby securing the plurality of links in the fist set of notches in the hanger body cover.

38. The cable hanger of claim 37 wherein the cable groove of the hanger body and the cable groove of the hanger body cover are offset toward the first set of notches in both the hanger body and in the hanger body cover.

39. The cable hanger of claim 38 further comprising a second set of notches in the hanger body and a second set of notches in the hanger body cover, said notches designed to receive the plurality of connecting bolts.

40. The cable hanger of claim 39 wherein the plurality of connecting bolts each have an opening passing through an end of the connecting bolts.

41. The cable hanger of claim 40 further comprising a rod passing through the opening in the end of each of the plurality of connecting bolts and passing through the hanger body, thereby securing the plurality of connecting bolts in the second set of notches in the hanger body.

42. The cable hanger of claim 41 further comprising a washer plate with a plurality of openings for allowing an end of each of the plurality of connecting bolts to pass through the washer plate.

43. The cable hanger of claim 30 wherein the plurality of connector rods are threadably connected to the hanger body.

44. The cable hanger of claim 30 wherein each of the plurality of connector rods passes through the handle.

45. A method of securing a cable in a cable hanger, the method comprising:

providing a hanger body comprising a cable groove for receiving a cable, the cable groove formed such that it is offset from the centerline of the hanger body;

providing a hanger body cover comprising a cable groove for receiving the cable, the cable groove formed such that it is offset from the centerline of the hanger body cover such that it lines up with the cable groove of the hanger body when the hanger body cover and the hanger body are in a closed position;

providing a liner positioned in the cable groove of the hanger body;

providing a liner positioned in the cable groove of the hanger body cover;

securing the liner in the cable groove of the hanger body and securing the liner in the cable groove of the hanger body with a plurality of screws;

providing a handle for the cable hanger, the handle having a groove therein for receiving the cable;

connecting the handle to the hanger body with a plurality of connector rods;

connecting the hanger body cover to the hanger body with a plurality of links;

providing a plurality of connecting bolts and a plurality of fasteners;

passing the cable through the cable hanger such that the cable is located within the cable groove of the hanger body and passes through the groove in the handle;

positioning the hanger body cover in a closed position about the cable whereby the cable is located within the cable groove in the hanger body cover;

using the plurality of connecting bolts and the plurality of fasteners to secure the hanger body cover and the hanger body in the closed position.

46. The method of claim 45 wherein the plurality of screws do not pass through the liner in the cable groove of the hanger body or through the liner of the cable groove of the hanger body cover.

47. The method of claim 46 further comprising securing the liner in the cable groove of the hanger body and securing the liner in the cable groove of the hanger body cover with a portion of heads of the plurality of screws.

48. The method of claim 45 further comprising providing a first set of notches in the hanger body and a first set of notches in the hanger body cover, said notches designed to receive the plurality of links.

49. The method of claim 48 further comprising providing each of the plurality of links with a plurality of openings passing through the links.

50. The method of claim 49 further comprising securing the plurality of links in the first set of notches in the hanger body by passing a rod through one of the plurality of openings of each of the plurality of links and through the hanger body.

51. The method of claim 50 further comprising securing the plurality of links in the first set of notches in the hanger body cover by passing a rod through one of the plurality of openings of each of the plurality of links and through the hanger body cover.

52. The method of claim 51 further comprising providing a second set of notches in the hanger body and providing a second set of notches in the hanger body cover, said notches designed to receive the plurality of connecting bolts.

53. The method of claim 52 further comprising providing each of the plurality of connecting bolts with an opening passing through an end of the connecting bolts.

54. The method of claim 53 further comprising securing the plurality of connecting bolts in the second set of notches in the hanger body by passing a rod through the opening in the end of each of the plurality of connecting bolts and through the hanger body and securing the rod within the hanger body with one or more spring pins.

55. The method of claim 53 further comprising securing the plurality of connecting bolts in the second set of notches in the hanger body cover by passing a rod through the opening in the end of each of the plurality of connecting bolts and through the hanger body cover and securing the rod within the hanger body cover with one or more spring pins.

56. The method of claim 54 further comprising providing a washer plate with a plurality of openings for allowing an end of each of the plurality of connecting bolts to pass through the washer plate.

57. The method of claim 56 further comprising rotating the plurality of connecting bolts about the rod securing them in the second set of notches in the hanger body until a portion of each of the plurality of connecting bolts is within the second set of notches in the hanger body cover.

58. The method of claim 56 whereby all of the plurality of connecting bolts are rotated at the same time through movement of the washer plate.

59. The method of claim 58 wherein the plurality of fasteners comprise nuts that we secured to a threaded portion of the plurality of connecting bolts.

60. The method of claim 59 further comprising tightening the nuts onto the plurality of connecting bolts such that the hanger body cover and the hanger body are clamped in a closed position about the cable.

61. The method of claim 45 further comprising forming the hanger body and the hanger body cover by casting the hanger body as one piece and by casting the hanger body cover as one piece.

62. The method of claim 61 further comprising inspecting the hanger body and the hanger body cover by magnetic particle inspection prior to assembling the cable hanger.

63. A cable hanger comprising:

a hanger body having a cable groove for receiving a cable;

a hanger body cover having a cable groove for receiving the cable, the grooves of the hanger body cover and hanger body being configured such that each groove is offset from a centerline of the hanger body, thereby securing the cable in an off-center position when the hanger body and hanger body cover are in a closed position;

a handle connected to the hanger body cover by one or more connector rods, the handle having a groove therein for receiving the cable;

a plurality of links for operatively connecting the hanger body cover to the hanger body;

a plurality of connecting bolts and a plurality of fasteners, the plurality of connecting bolts and the plurality of fasteners designed to clamp the hanger body cover and the hanger body in the closed position about the cable.

64. A method of securing a cable in a cable hanger, the method comprising:

providing a hanger body comprising a cable groove for receiving a cable, the cable groove formed such that it is offset from the centerline of the hanger body;

providing a hanger body cover comprising a cable groove for receiving the cable, the cable groove formed such that it is offset from the centerline of the hanger body cover such that it lines up with the cable groove of the hanger body when the hanger body cover and the hanger body are in a closed position;

providing a liner positioned in the cable groove of the hanger body;

providing a liner positioned in the cable groove of the hanger body cover;

securing the liner in the cable groove of the hanger body and securing the liner in the cable groove of the hanger body with a plurality of screws;

providing a handle for the cable hanger, the handle having a groove therein for receiving the cable;

connecting the handle to the hanger body cover with a plurality of connector rods;

connecting the hanger body cover to the hanger body with a plurality of links;

providing a plurality of connecting bolts and a plurality of fasteners;

passing the cable through the cable hanger such that the cable is located within the cable groove of the hanger body and passes through the groove in the handle;

positioning the hanger body cover in a closed position about the cable whereby the cable is located within the cable groove in the hanger body cover;

using the plurality of connecting bolts and the plurality of fasteners to secure the hanger body cover and the hanger body in the closed position.

* * * * *